US009334085B2

(12) United States Patent
Persson et al.

(10) Patent No.: US 9,334,085 B2
(45) Date of Patent: May 10, 2016

(54) CONTAINERS FOR LIQUID

(71) Applicant: Husqvarna AB, Huskvarna (SE)

(72) Inventors: Alexander Persson, Tenhult (SE); Jan Svanberg, Alingsås (SE)

(73) Assignee: HUSQVARNA AB, Huskvarna (SE)

( * ) Notice: Subject to any disclaimer, the term of this patent is extended or adjusted under 35 U.S.C. 154(b) by 0 days.

(21) Appl. No.: 14/429,569

(22) PCT Filed: Sep. 19, 2012

(86) PCT No.: PCT/EP2012/068439
§ 371 (c)(1),
(2) Date: Mar. 19, 2015

(87) PCT Pub. No.: WO2014/044306
PCT Pub. Date: Mar. 27, 2014

(65) Prior Publication Data
US 2015/0225124 A1 Aug. 13, 2015

(51) Int. Cl.
*B65D 25/48* (2006.01)
*B65D 25/28* (2006.01)
(Continued)

(52) U.S. Cl.
CPC ..... *B65D 25/48* (2013.01); *B65D 25/24* (2013.01); *B65D 25/2802* (2013.01);
(Continued)

(58) Field of Classification Search
CPC ..... B65D 25/2885; B65D 25/2894; B65D 25/2897; B65D 25/24; B65D 25/48; B65D 2525/282
USPC ..... 222/475, 466; 220/771, 772, 661
See application file for complete search history.

(56) References Cited

U.S. PATENT DOCUMENTS 3,250,434 A * 5/1966 Howlett ..... B65D 71/02 206/229
3,845,884 A 11/1974 Hall et al.
(Continued)

FOREIGN PATENT DOCUMENTS

CA 2697429 A1 9/2010
DE 29702273 U1 4/1997
(Continued)

OTHER PUBLICATIONS

Rotopax, "2 Gallon Gasoline Pack", 2015, http://rotopax.com/2-Gallon-Gasoline.html.
(Continued)

*Primary Examiner* — Donnell Long
(74) *Attorney, Agent, or Firm* — Nelson Mullins Riley & Scarborough LLP

(57) ABSTRACT

A container for liquid (1; 51), comprising a body in which liquid can be stored, in which the body has a orifice (8; 58) allowing access into the void, the body being provided with a handle (10; 60) arranged to be grasped by a user, the container being provided with an elongate spout (9; 59) that removably engages the orifice (8; 58), the handle being provided with a location (71) for storage of the spout. Additionally, a container (1; 51) for liquid, comprising a body in which liquid can be stored, the body having a base (2; 52; 72), two opposing side faces (3; 53), the side faces (3;53) being joined by first and second opposing side walls (4, 5; 54, 55), the side faces and the side walls being capped by a top wall (6; 56) opposing the base, in which the top wall (6; 56) has a orifice (8;57) adjacent to the first side wall (4; 54), in which both the first and second side walls are provided with handles (10, 11; 60, 61).

19 Claims, 7 Drawing Sheets

(51) Int. Cl.
*B65D 25/24* (2006.01)
*B65D 85/00* (2006.01)

(52) U.S. Cl.
CPC ..... *B65D 25/2885* (2013.01); *B65D 25/2894* (2013.01); *B65D 25/2897* (2013.01); *B65D 85/70* (2013.01); *B65D 2525/282* (2013.01)

(56) References Cited

U.S. PATENT DOCUMENTS

| | | | | |
|---|---|---|---|---|
| 4,069,946 | A * | 1/1978 | Flider | B65D 25/385 16/111.1 |
| 4,392,594 | A * | 7/1983 | Swett | A01G 25/14 222/475 |
| D271,113 | S | 10/1983 | Birkeland et al. | |
| 4,541,529 | A * | 9/1985 | Hestehave | B65D 21/023 16/436 |
| 4,658,975 | A | 4/1987 | Cone | |
| 4,804,119 | A | 2/1989 | Goodall | |
| 4,834,269 | A * | 5/1989 | Cone | B65D 1/12 220/771 |
| D303,496 | S | 9/1989 | Larson | |
| 4,923,098 | A | 5/1990 | Schoonover et al. | |
| 4,969,571 | A | 11/1990 | Bartz | |
| 5,226,574 | A | 7/1993 | Durinzi, Jr. | |
| 6,237,792 | B1 | 5/2001 | Skolnicki et al. | |
| 6,397,902 | B1 | 6/2002 | Murphy | |
| 6,832,705 | B2 | 12/2004 | Hollander et al. | |
| 7,097,061 | B2 * | 8/2006 | Simpson, Jr. | B65D 1/0223 215/373 |
| D528,424 | S | 9/2006 | Archeny et al. | |
| 2,517,115 | A1 | 2/2007 | Pick | |
| 7,182,214 | B2 * | 2/2007 | Darr | B65D 1/0223 215/365 |
| D573,885 | S | 7/2008 | Considine et al. | |
| D595,583 | S | 7/2009 | Lovelace, Jr. et al. | |
| 2010/0059536 | A1 | 3/2010 | Stolk | |
| 2010/0155434 | A1 | 6/2010 | Bradford | |
| 2012/0325866 | A1 * | 12/2012 | Lee | B65D 25/42 222/466 |

FOREIGN PATENT DOCUMENTS

| | | | |
|---|---|---|---|
| DE | 202005006134 | U1 | 6/2005 |
| DE | 202005013559 | U1 | 1/2006 |
| DE | 202011050981 | U1 | 10/2011 |
| EP | 2363348 | A1 | 9/2011 |
| FR | 438566 | A | 5/1912 |
| FR | 2549012 | A1 | 1/1985 |
| JP | 2005289513 | A | 10/2005 |

OTHER PUBLICATIONS

Dirtbike Bitz, "Tuff Jug & Ripper Refuelling System—Petrol Can", 2015, http://www.dirtbikebitz.com/tuff-jug-ripper-refuelling-system-petrol-can-white-p-3092.html.

Birchmeier, "Birchmeier RAPIDON Quick Fill Can 6 Liter", http://www.birchmeier.com/de/content/home.php.

International Search Report and Written Opinion of PCT/EP2012/068439, mailed on Jan. 10, 2013.

Chapter II of the International Preliminary Report on Patentability of PCT/EP2012/068439, completed on Jan. 27, 2014.

* cited by examiner

CONTAINERS FOR LIQUID

This invention relates to containers for liquid, particularly although non-exclusively for containing fuels.

The internal combustion engine is ubiquitous in modern society, and brings with it the need to fuel such engines. Whilst it is relatively easy to drive a road vehicle powered by such an engine to a filling station, for garden-based vehicles not adapted for road use, and for petrol driven garden equipment such as lawnmowers, it is inconvenient to do so. As such, it is necessary to use a container, such as a jerry can to transport the fuel from a dispensing point such as a filling station to the equipment in question. Typical fuels include hydrocarbon based fuels such as petrol/gasoline, diesel or ethanol.

Once full, such containers can be unwieldy—a full 15 liter container will have a mass of around 15 kilograms. As such, it is desirable to provide an ergonomic solution to the handling of such containers.

It is also known to provide a removable spout to aid in the emptying of such containers. However, this provides a further item that must be carried, and there is a risk that the separate spout can be mislaid.

According to a first aspect of the invention, there is provided a container for liquid, comprising a body defining a void in which liquid can be stored, in which the body has a orifice allowing access into the void, the body being provided with a handle arranged to be grasped by a user, the container being provided with an elongate spout that removably engages the orifice, the handle being provided with a location for storage of the spout.

As such, this provides a convenient storage location for the spout.

The location may comprise a first portion of the handle sufficiently wide such that the spout can pass through along its length and a second portion adjacent to the first portion, the spout being able to move from the first portion into the second portion at at least one position along its length, the second portion being narrower than the first portion such that once moved into the second portion, the spout can no longer be removed from the second portion along the length of the spout. This provides a convenient storage for the spout.

As such, the spout may comprise a waist providing a local minimum in a width of the spout perpendicular to its length, the waist defining the position at which the spout can be moved into the second portion of the handle.

The handle may comprise a through passage through the body of the container, within which are the first and second positions. With the spout in the second portion, the through passage may be sufficiently large to allow the passage of a user's hand; as such, the cross-sectional area of the through passage remaining with the spout in the second position preferably may be at least 80 mm by 35 mm.

The body may have a base on which the container can be stably stood, two opposing side faces extending away from the base, the side faces being joined by first and second opposing side walls extending away from the base, the side faces and the side walls being capped by a top wall opposing the base. The orifice may be in the top wall adjacent to one of the side walls with both the first and second side walls being provided with handles arranged to be grasped by a user, the location being in one of the handles. The orifice may extend substantially perpendicular to the base.

The top wall may also be provided with a handle; this will help with lifting the container, particularly when full of a dense liquid.

Each of the handles may comprise a recess in the body. The recess may be a blind recess, which does not pass through the body, or a through recess, which forms a passage through the body. Typically, the handle in the first side wall will be a through recess, and the handle in the second side wall will be a blind recess.

At least one of the side walls may be provided with a plurality of feet, on which the container may be stably stood. The feet may also extend into, and act to stiffen the side faces. Typically, the second side wall may be provided with the feet. The handle in the second side wall may be provided in one of the feet; this has the advantage that the handle will be located in a particularly sturdy portion of the side wall.

Typically, the liquid may be a hydrocarbon-based fuel, such as petrol (otherwise known as gasoline), diesel fuel or ethanol. The container may contain the liquid.

According to a second aspect of the invention, there is provided a container for liquid, comprising a body defining a void in which liquid can be stored, the body having a base on which the container can be stably stood, two opposing side faces extending away from the base, the side faces being joined by first and second opposing side walls extending away from the base, the side faces and the side walls being capped by a top wall opposing the base, in which the top wall has a orifice adjacent to the first side wall, the orifice allowing access into the void, in which both the first and second side walls are provided with handles arranged to be grasped by a user.

By providing both handles, the complete emptying of the container has been found to be more ergonomic, particularly with the orifice provided adjacent to the first side wall, therefore being easier to place adjacent to a filler orifice or other such desired location for the liquid when it is being poured out of the container.

The top wall may also be provided with a handle; this will help with lifting the container, particularly when full of a dense liquid.

Each of the handles may comprise a recess in the body. The recess may be a blind recess, which does not pass through the body, or a through recess, which forms a passage through the body. Typically, the handle in the first side wall will be a through recess, and the handle in the second side wall will be a blind recess.

The container may be provided with an elongate spout that removably engages the orifice. This will assist in dispensing the liquid. One of the handles may be provided with a location for storage of the spout, particularly a handle provided as a through recess such as that in the first side wall.

The orifice may extend substantially perpendicular to the base. This has the advantages that:

- when filling liquid into a tank the position of the spout can still be observed, as it is not obstructed by the body, as in the case of a 45° angled spout
- the filling of liquid is still possible even if the orifice of a tank is close to a wall
- when positioning the spout at the orifice of a tank, the spout's position can easily be seen; with a 45° spout one would have to turn the canister for positioning.

The location may comprise a first portion of the handle sufficiently wide such that the spout can pass through along its length and a second portion adjacent to the first portion, the spout being able to move from the first portion into the second portion at at least one position along its length, the second portion being narrower than the first portion such that once moved into the second portion, the spout can no longer be removed from the second portion along the length of the spout. This provides a convenient storage for the spout.

As such, the spout may comprise a waist providing a local minimum in a width of the spout perpendicular to its length, the waist defining the position at which the spout can be moved into the second portion of the handle.

At least one of the side walls may be provided with a plurality of feet, on which the container may be stably stood. The feet may also extend into, and act to stiffen the side faces. Typically, the second side wall may be provided with the feet. The handle in the second side wall may be provided in one of the feet; this has the advantage that the handle will be located in a particularly sturdy portion of the side wall.

Typically, the liquid may be a hydrocarbon-based fuel, such as petrol (otherwise known as gasoline), diesel fuel or ethanol. The container may contain the liquid.

The container of either aspect of the invention may be provided with a stopper, arranged so as to block the orifice when the spout is not being used.

The orifice of either aspect may be the only access into the void.

There now follows, by way of example only, description of embodiments of the invention, described with reference to the accompanying drawings, in which.

Figure 1:
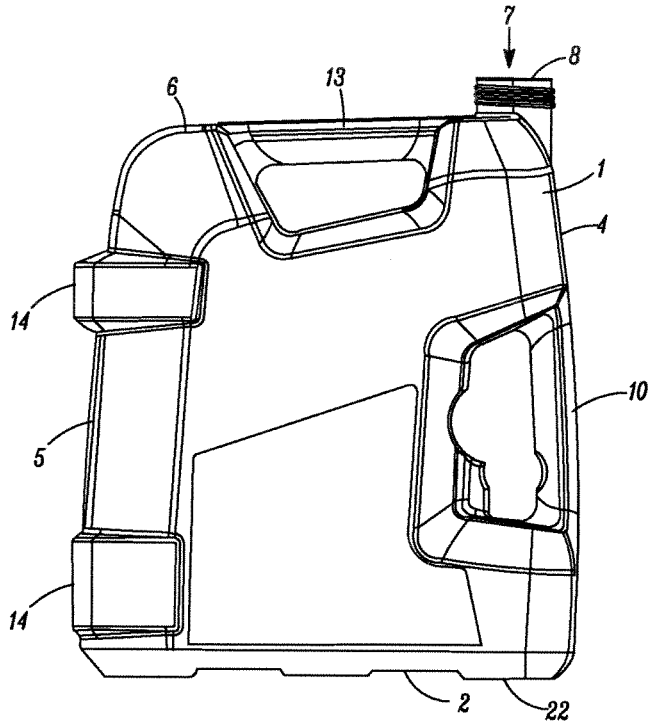
FIG. 1 shows a side elevation of a container for petroleum spirit in accordance with a first aspect of the invention.
Figure 2:
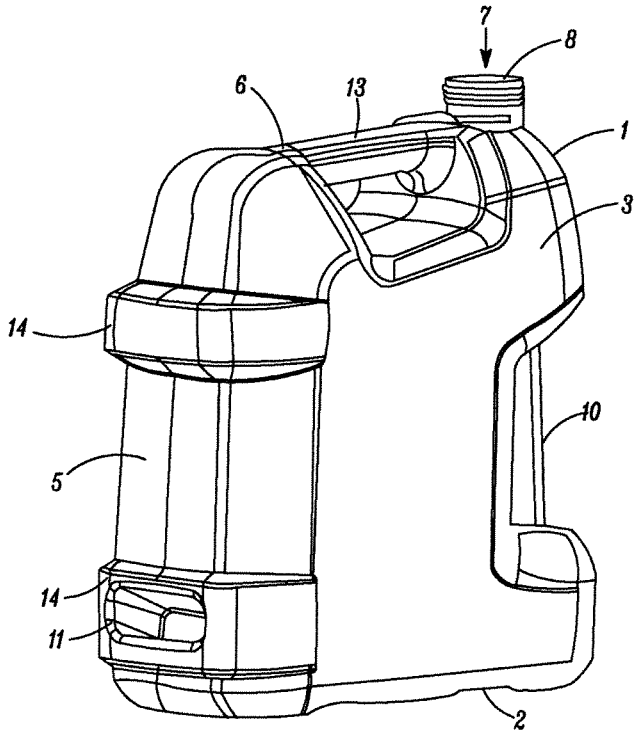
FIG. 2 shows a perspective view of the container of FIG. 1.

A container for a hydrocarbon-based fuel, such as petrol, otherwise known as gasoline, diesel fuel or ethanol, such as may be used with a ride-on mower or other petrol-driven garden equipment in accordance with a first embodiment of the invention is shown in FIGS. 1 to 6 of the accompanying drawings. The container 1 has a base 2 (on which the container 1 can be stood) and two opposing side faces 3 (only one of which can be seen in the drawings—the container is generally symmetric about a central plane parallel to the side faces, and so the side face 3 furthest from the viewpoints of the drawings corresponds to that which can be seen) extending from the base 2. The side faces 3 are joined by opposing first side wall 4 and second side wall 5 which both also extend from base 2. The side faces 3 and side walls 4, 5 are capped by a top wall 6. The side faces 3, side walls 4, 5, base 2 and top wall 6 therefore define a body having a void 7 therein in which petroleum spirit can be stored.

The top wall 6 has an orifice 8 which allows the container to be filled or emptied. The orifice 8 is adjacent to the first side wall 4 and extends perpendicularly to the base 2. The container 1 is also provided with a removable spout 9 which can engage this orifice 8.

The side walls 4, 5 are both provided with handles 10, 11. The handle 10 in the first side wall 4 is of the form of a through passage through the body of the container 1, leaving a generally tubular part which can be grasped by a user 12. The handle 11 in the second side wall 5 is of the form of a recess sufficiently close to the base 2 that the user 12 can place his fingers in the recess whilst grasping onto the base 2 (as shown in FIG. 4 of the accompanying drawings).

There is also a further handle 13 provided as a through passage in the top wall 6; again, a through passage is provided in the body of the container, leaving a tubular part for the user to grasp.

As such, the handles 10, 11, 13 provide an ergonomic solution to the manual handling of the container. Given that the container can contain up to 15 liters of petroleum spirit, the mass of the full container can easily be in the region of 15 kg, which unless handled correctly can be quite unwieldy.

Figure 4:
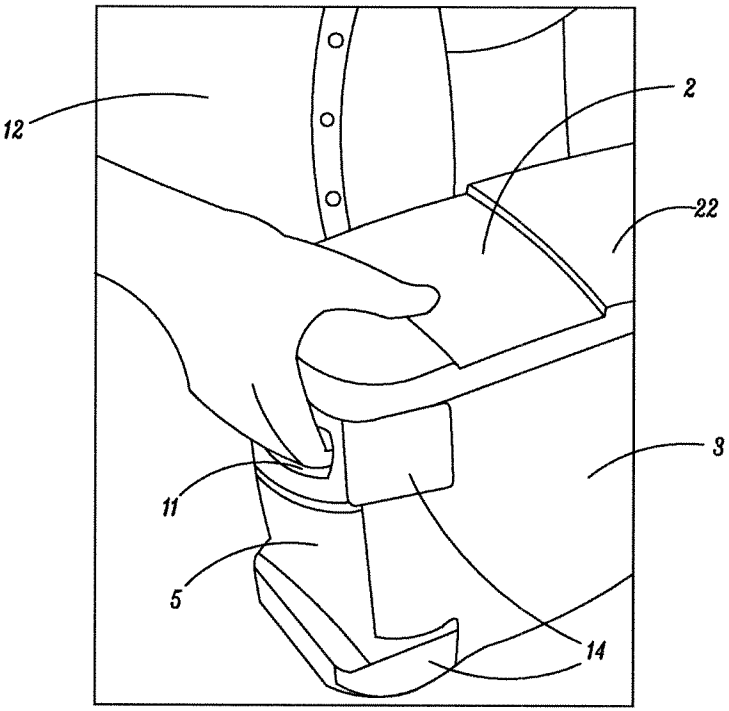
FIG. 4 shows a close up view of FIG. 3, showing one of the handles.
Figure 3:
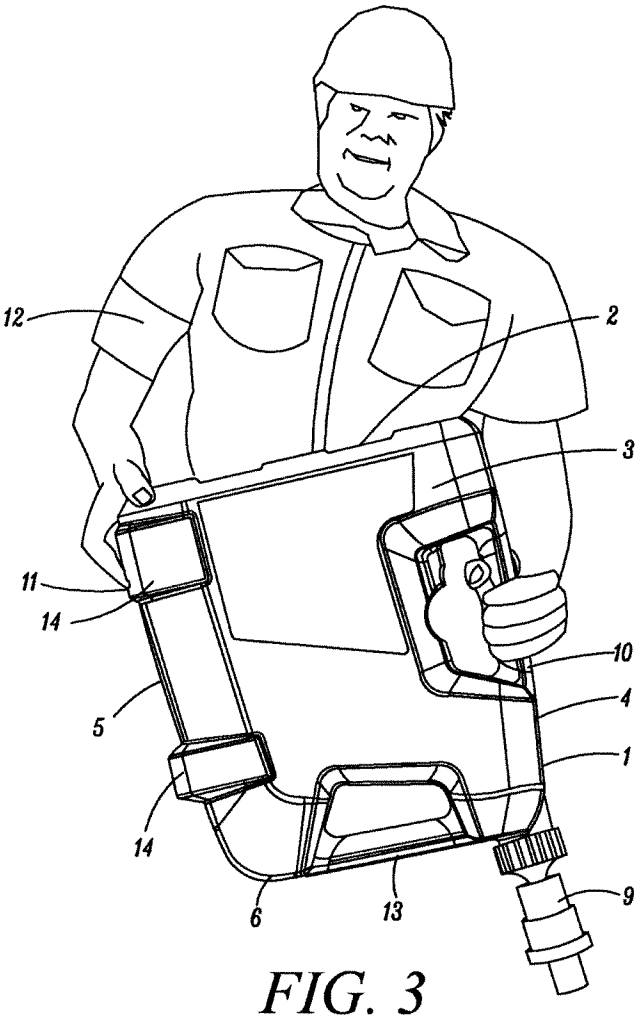
FIG. 3 shows a view of a user emptying the container of FIG. 1.

The handles 10, 11 in the side walls 4, 5 make it much easier for the user 12 to invert the container (as shown in FIGS. 3 and 4 of the accompanying drawings) whilst still providing the container with support whilst it is emptied. Furthermore, given that the top wall 6 is elongate in the direction from the first side wall 4 to the second side wall 5, having the orifice 8 at an edge of the top wall 6 adjacent to the first side wall 4 means that it will be easier to offer up the orifice and/or the spout 9 to a filling cap in a small vehicle such as ride-on mower, where the filling cap is often in an awkward position such as immediately adjacent to the seat.

Figure 6:
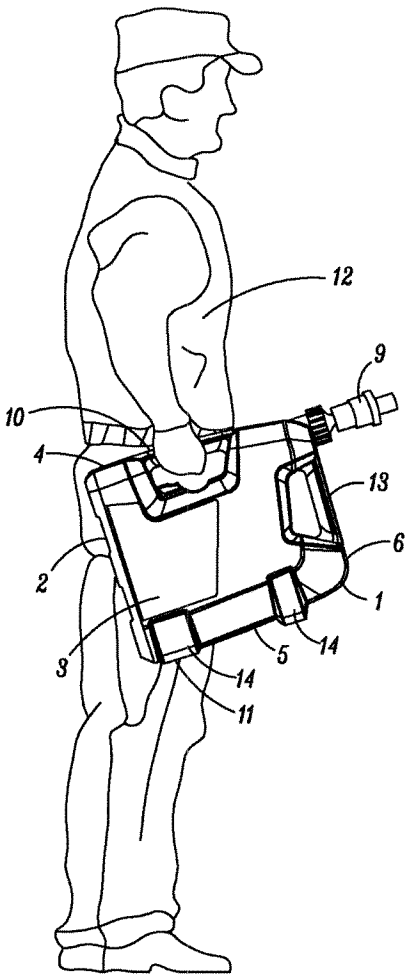
FIG. 6 shows a view of the user carrying the container of FIG. 1 in a rotated position.
Figure 5:
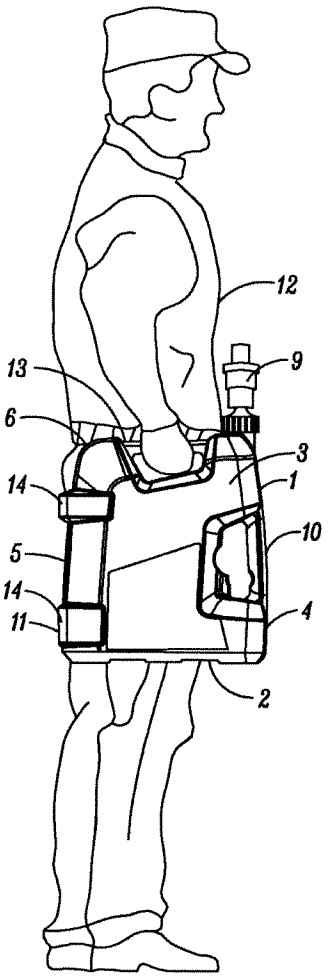
FIG. 5 shows a view of the user carrying the container of FIG. 1 in an upright position.
Figure 7:
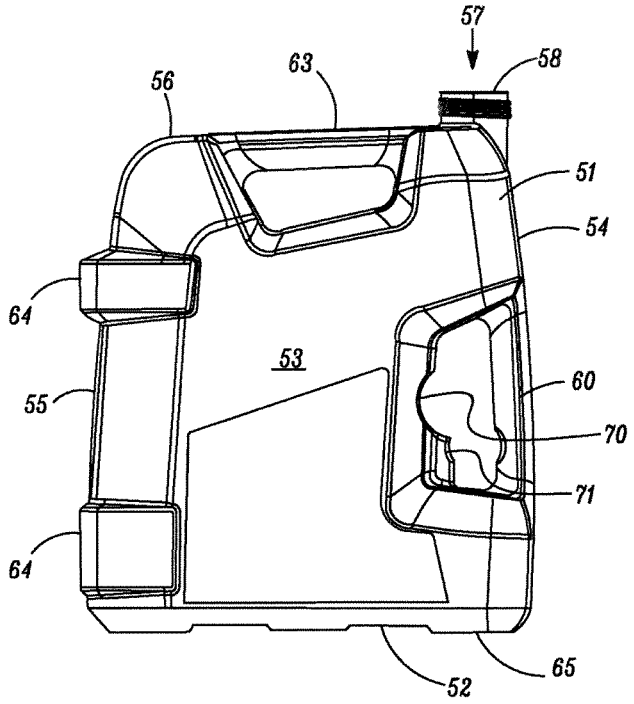
FIG. 7 shows a side view of a container for petroleum spirit in accordance with a second embodiment of the invention.
Figure 8:
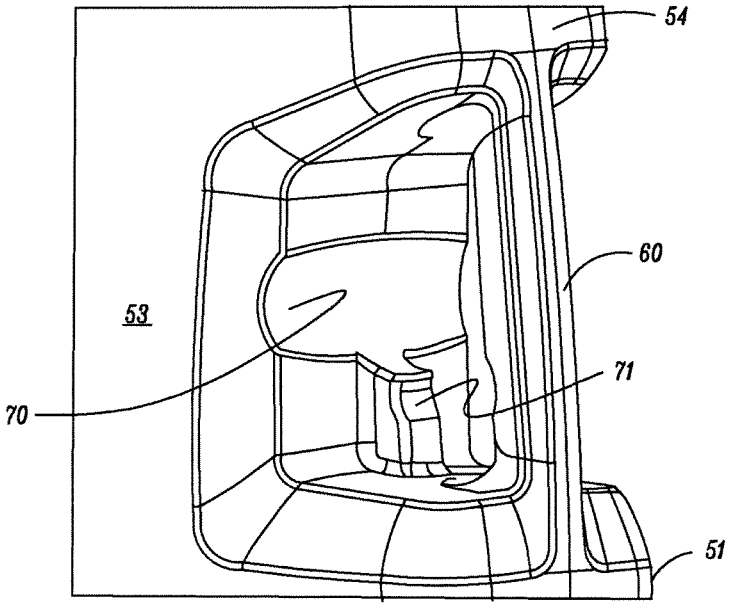
FIG. 8 shows a close up perspective view of the handles of the container of FIG. 7.

The handle 13 in the top wall 6 provides a convenient way that the container can be carried, as shown in FIG. 5 of the accompanying drawings, whilst FIG. 6 shows that the handle 10 in the first side wall 4 can also be used in a rotated orientation of the container 1.

The second side wall 5 is also provided with two feet 14, which serve several purposes. Firstly, the container 1 can be stood on the feet 14, so that the container is stable with the second side wall 5 downwards. Secondly, the feet 14 can serve to stiffen the container 1, and in particular the side faces 3. Thirdly, the foot 14 adjacent to the base 2 can house the handle 11 in the second side wall 5; this is advantageous as it allows the handle 11 to be in a particularly sturdy portion of the container 1.

Feet 22 are also provided on the base 2 for stability.

A container 51 in accordance with a second embodiment of the invention is shown in FIGS. 8 to 11 of the accompanying drawings. Equivalent integers to the first embodiment have been referenced with equivalent reference numerals, raised by 50. The container 51 with its handles 60, 61, 63 are almost identical in shape and function to the first embodiment. This embodiment differs in that the spout 59 can be stored in the handle 60 in the first side wall 54.

As such, the through passage of handle 60 is provided with two adjacent passages 70, 71 for the spout 59. The first, larger passage 70 through the handle 60 is large enough that the spout 59 can pass along the entirety of its length through the passage 70. The second, smaller passage 71 can surround a narrow waist of the spout 59 but will not otherwise allow the spout 59 to move along its length.

Figure 9:
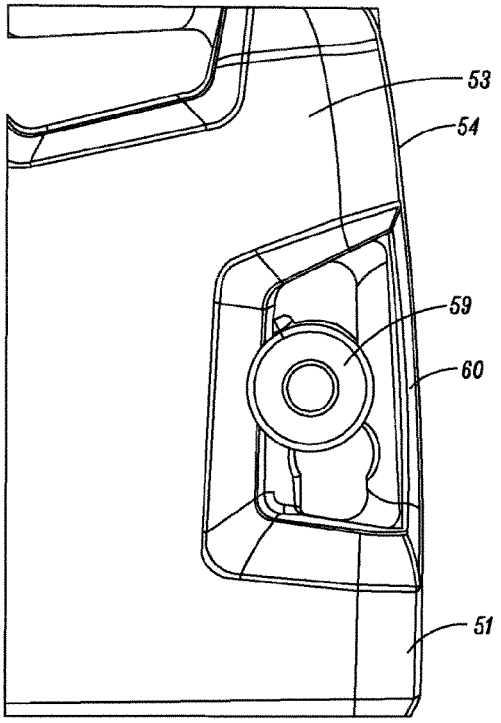
FIG. 9 shows a side view of the handle of FIG. 8, with a spout inserted therethrough.
Figure 10:
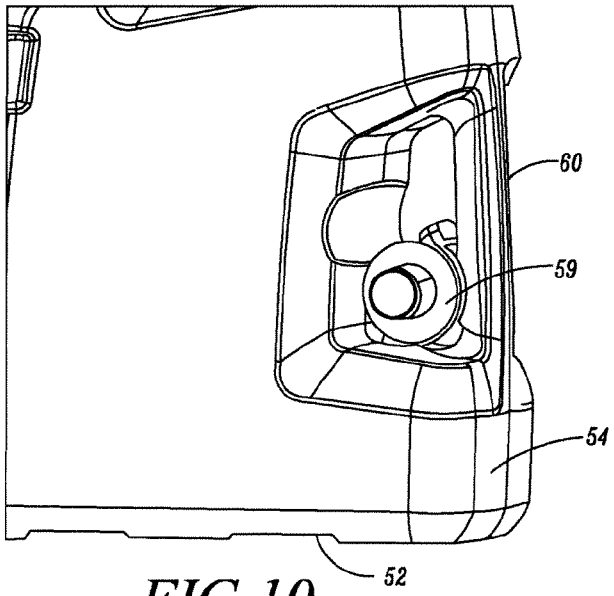
FIG. 10 shows a perspective view of the handle of FIG. 8, with the spout stowed in the handle.
Figure 11:
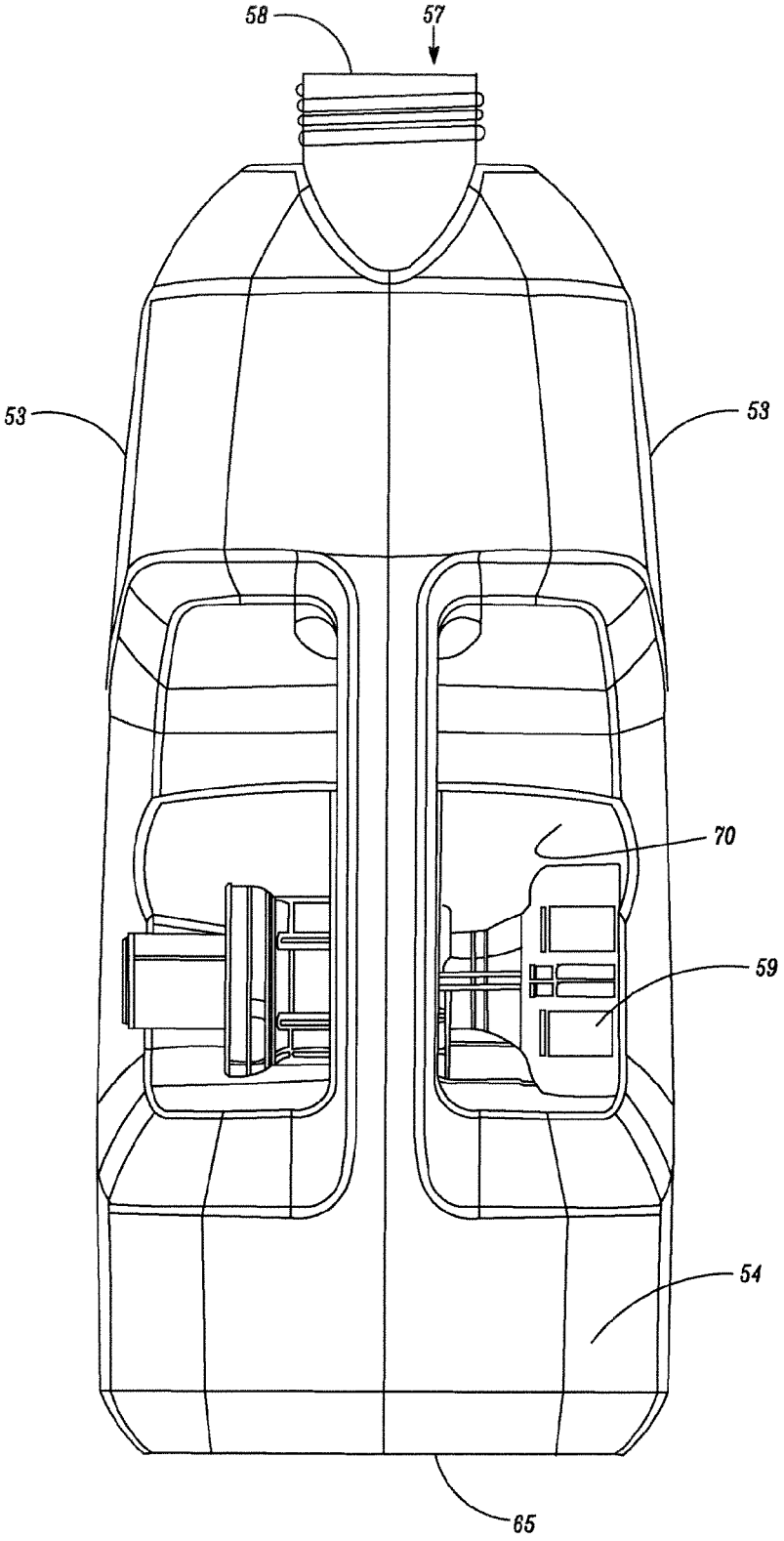
FIG. 11 shows a side view of the container of FIG. 7 (from a position rotated through 90 degrees with respect to FIG. 9), with the spout stowed in the handle.

As such, the spout 59 can be introduced into the first passage 70, as shown in FIG. 9 of the accompanying drawings. It is passed through until the narrow waist is in the first passage 70; the spout 59 is then slid sideways, perpendicular to the length of the spout 59, until the narrow waist is in the second passage 71 (as shown in FIGS. 10 and 11 of the accompanying drawings). Because the narrow waist cannot escape the second passage 71 lengthways, the spout 59 is now securely stored in the handle 60. Furthermore, the handle 60 is still wide enough so that the user can pass his hand through the handle 60, in order to pick up the container.

Feet 65 are also provided on the base 52 for stability.

Figure 12:
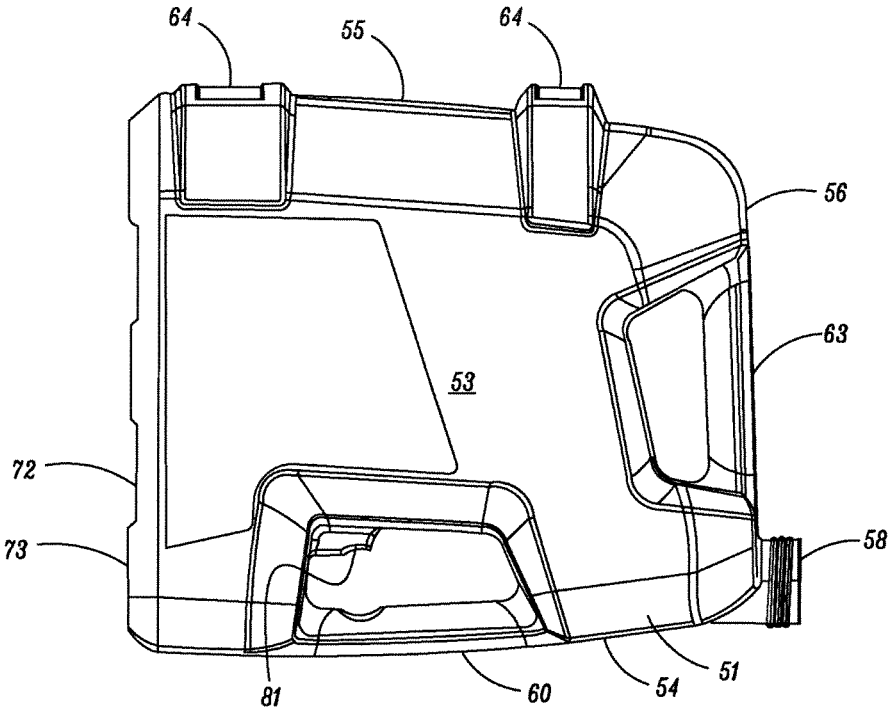
FIG. 12 shows a side view of a container for petroleum spirit in accordance with a third embodiment of the invention.
Figure 13:
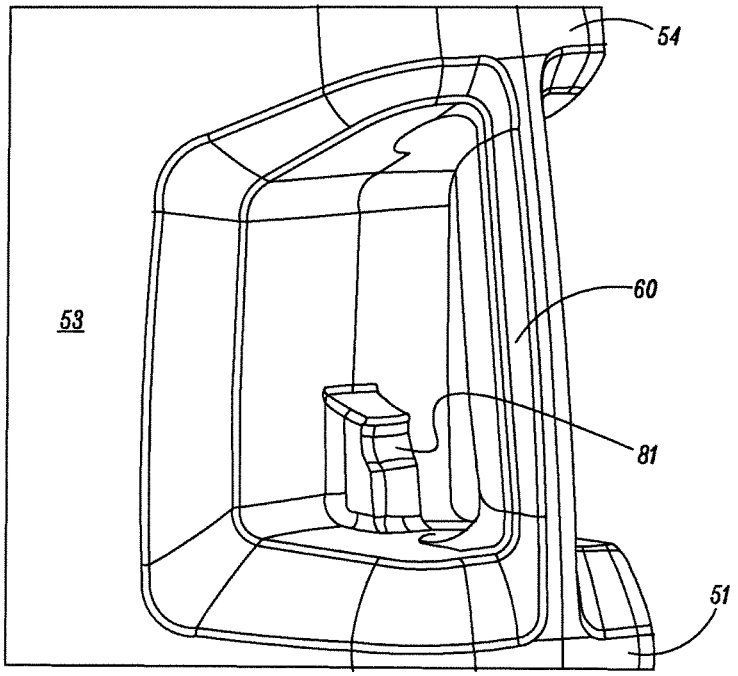
FIG. 13 shows a perspective view of the handle of the container of FIG. 12.

A container in accordance with a third embodiment of the invention is shown in FIGS. 12 and 13 of the accompanying drawings. This functions in the same manner as the previous embodiments, and equivalent reference numerals have been given to features of the second embodiment.

In this embodiment, rather than having two passages 70, 71 of generally circular outline, a single passage 81 is provided. This corresponds to the second passage 71 of the second embodiment. The first passage 70 of the second embodiment is provided by the passage through handle 60 itself—there is no specific passage 70, but the spout 59 can pass through the handle 60 passage and be placed adjacent to the single passage 81, before being slid securely into place.

Feet 73 are again provided on base 72 for stability.

The invention claimed is:

1. A container for liquid, comprising a body defining a void in which liquid can be stored, in which the body has an orifice allowing access into the void, the body being provided with a handle arranged to be grasped by a user, the container being provided with an elongate spout that removably engages the orifice, the handle being provided with a location for storage of the spout, wherein the location comprises a first portion of the handle sufficiently wide such that the spout can pass through along its length and a second portion adjacent to the first portion, the spout being able to move from the first portion into the second portion at at least one position along its length, the second portion being narrower than the first portion such that once moved into the second portion, the spout can no longer be removed from the second portion along the length of the spout, and wherein the spout comprises a waist providing a local minimum in a width of the spout perpendicular to its length, the waist defining the position at which the spout can be moved into the second portion of the handle.

2. The container of claim 1, in which the handle comprises a through passage through the body of the container, within which are a first position and a second position, in which, with the spout in the second portion, the through passage being sufficiently large to allow the passage of a user's hand.

3. The container of claim 1, in which the body has a base on which the container can be stably stood and two opposing side faces extending away from the base, the side faces being joined by first and second opposing side walls extending away from the base, the side faces and the first and second side walls being capped by a top wall opposing the base, the orifice being in the top wall adjacent to one of the first or second side walls with both the first and second side walls being provided with handles arranged to be grasped by a user, the location being in one of the handles in the first and second side walls.

4. The container of claim 3, in which the top wall is provided with a handle.

5. The container of claim 3, in which the second side wall is provided with a plurality of feet, on which the container can be stably stood.

6. The container of claim 5, in which the feet extend into, and act to stiffen, the side faces.

7. The container of claim 5 in which the handle in the second side wall is provided in one of the feet.

8. A container for liquid, comprising a body defining a void in which liquid can be stored, the body having a base on which the container can be stably stood, two opposing side faces extending away from the base, the side faces being joined by first and second opposing side walls extending away from the base, the side faces and the first and second side walls being capped by a top wall opposing the base, in which the top wall has a orifice adjacent to the first side wall, the orifice allowing access into the void, and the orifice extends substantially perpendicular to the base, in which both the first and second side walls are provided with handles arranged to be grasped by a user, wherein the handle in the first side wall is in the form of a through passage through the body of the container, leaving a generally tubular part which can be grasped by a user for the container to be carried, and wherein the second side wall is provided with a plurality of feet, on which the container can be stably stood.

9. The container of claim 8, in which the top wall is provided with a handle.

10. The container of claim 8, in which the container is provided with an elongate spout that removably engages the orifice.

11. The container of claim 10, in which one of the handles is provided with a location for storage of the spout.

12. The container of claim 11, in which the location comprises a first portion of the handle sufficiently wide such that the spout can pass through along its length and a second portion adjacent to the first portion, the spout being able to move from the first portion into the second portion at at least one position along its length, the second portion being narrower than the first portion such that once moved into the second portion, the spout can no longer be removed from the second portion along the length of the spout.

13. The container of claim 12, in which the spout comprises a waist providing a local minimum in a width of the spout perpendicular to its length, the waist defining the position at which the spout can be moved into the second portion of the handle.

14. The container of claim 8, in which the base is provided with a plurality of feet, on which the container can be stably stood.

15. The container of claim 8, in which the feet extend into, and act to stiffen the side faces.

16. The container of claim 8, in which the handle in the second side wall is provided in one of the feet.

17. The container of claim 8, in which the liquid is a petroleum-based fuel.

18. The container of claim 8, provided with a stopper, arranged so as to block the orifice when the spout is not being used.

19. The container of claim 8, in which the orifice is the only access into the void.

* * * * *